US008649550B2

(12) United States Patent
Shi et al.

(10) Patent No.: US 8,649,550 B2
(45) Date of Patent: Feb. 11, 2014

(54) MULTI-MAGNET SYSTEM AND SPEAKER USING SAME

(75) Inventors: Lei Shi, Shenzhen (CN); Wen-tao Jiang, Shenzhen (CN); Xiong Zhang, Shenzhen (CN); San-you Wu, Shenzhen (CN); Lin-zhen Li, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 48 days.

(21) Appl. No.: 13/332,363

(22) Filed: Dec. 20, 2011

(65) Prior Publication Data

US 2012/0177246 A1 Jul. 12, 2012

(30) Foreign Application Priority Data

Jan. 6, 2011 (CN) ..... 2011 2 0002573 U
Jan. 6, 2011 (CN) ..... 2011 2 0002793 U
Jan. 7, 2011 (CN) ..... 2011 2 0004246 U

(51) Int. Cl.
*H04R 25/00* (2006.01)

(52) U.S. Cl.
USPC ..... 381/421; 381/414; 381/422; 381/424; 381/412

(58) Field of Classification Search
USPC ..... 381/401, 412, 414, 420, 421, 422, 424; 335/228, 229
See application file for complete search history.

(56) References Cited

U.S. PATENT DOCUMENTS

| | | | | |
|---|---|---|---|---|
| 3,129,298 | A * | 4/1964 | Hofman | 381/189 |
| 3,144,917 | A * | 8/1964 | Tressel | 187/290 |
| 8,144,917 | B2 * | 3/2012 | Won et al. | 381/421 |
| 2007/0140521 | A1 * | 6/2007 | Mitobe et al. | 381/420 |
| 2012/0008816 | A1 * | 1/2012 | Liu et al. | 381/401 |

* cited by examiner

*Primary Examiner* — Davetta W Goins
*Assistant Examiner* — Jasmine Pritchard
(74) *Attorney, Agent, or Firm* — Anova Law Group, PLLC

(57) ABSTRACT

Disclosed is a multi-magnet system for speaker. The multi-magnet system includes a yoke having a bottom, a pair of main magnets separated from each other and mounted on the bottom of the yoke, respectively, a mid-magnet mounted on the bottom of the yoke and located between the pair of main magnets, and a pair of auxiliary magnets attached to two ends of the yoke. Wherein, the first main magnet together with the first auxiliary magnet and the mid-magnet defines a first magnetic gap and the second main magnet together with the second auxiliary magnet and the mid-magnet defines a second magnetic gap. By virtue of place the magnets at appropriate locations, the sensitivity of the speaker is effectively enhanced.

15 Claims, 4 Drawing Sheets

MULTI-MAGNET SYSTEM AND SPEAKER USING SAME

FIELD OF THE INVENTION

The present disclosure relates to transducers to be mounted in terminal equipments for converting electrical signals to audible sounds, and more particularly to a speaker having a plurality of magnets.

DESCRIPTION OF RELATED ART

A speaker related to the present disclosure includes a holder, a strait magnetic circuit received in the holder, a wicker-shaped diaphragm located on the holder, and a voice coil attached to a bottom of the diaphragm. Typically, the magnetic circuit includes a yoke, a magnet positioned on the yoke, and a pole plate attached to the magnet. The yoke defines a magnetic gap together with the magnet and the voice coil is partially suspended in the magnetic gap. While electrified, the voice coil will be activated to vibrate by the electromagnetic Ampere Force and further drives the diaphragm to vibrate, which converts the electrical signals to sound waves.

For speakers with a long and narrow diaphragm and voice coil, the strait magnetic circuit can not provide sufficient magnetic force to drive the voice coil, as the results, the sensitivity of the speaker is reduced.

Therefore, it is desirable to provide a speaker which can overcome the above-mentioned problems.

Figure 1:
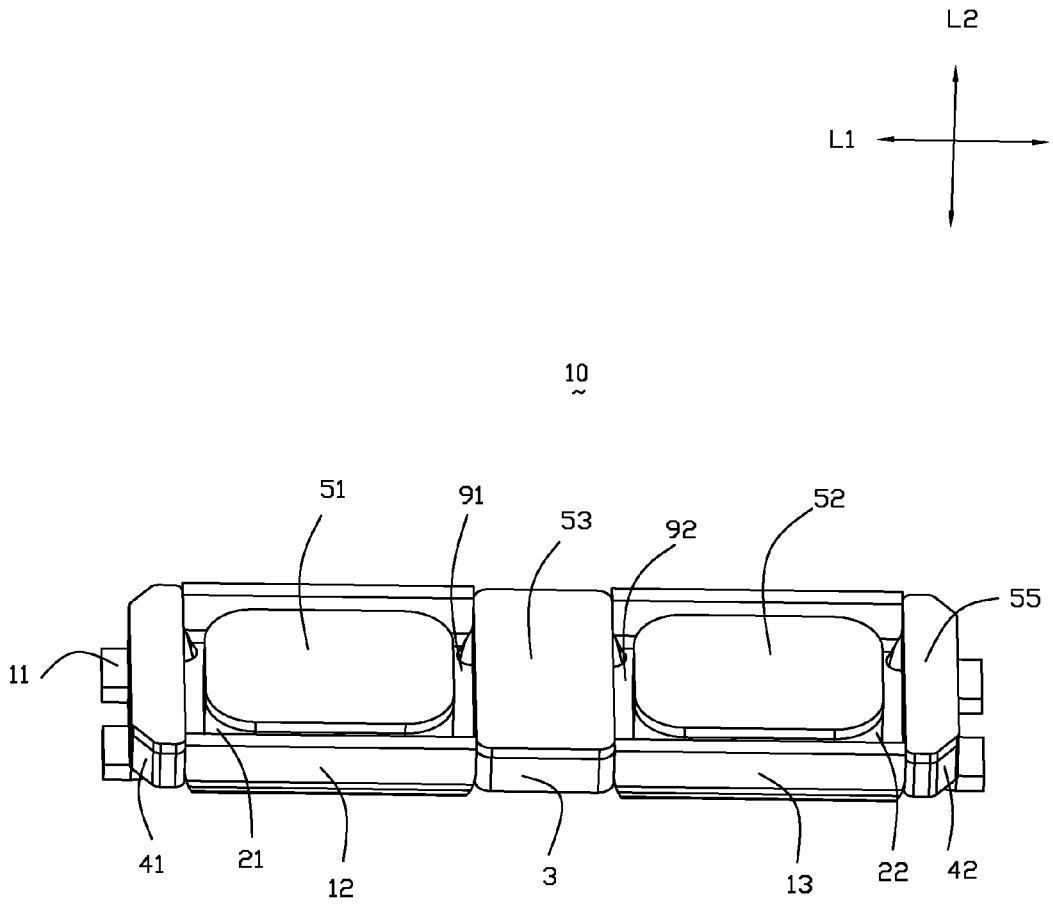
FIG. 1 is an illustrative assembled view of a multi-magnet system in accordance with a first exemplary embodiment of the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe exemplary embodiments of the present disclosure in detail.

Figure 2:
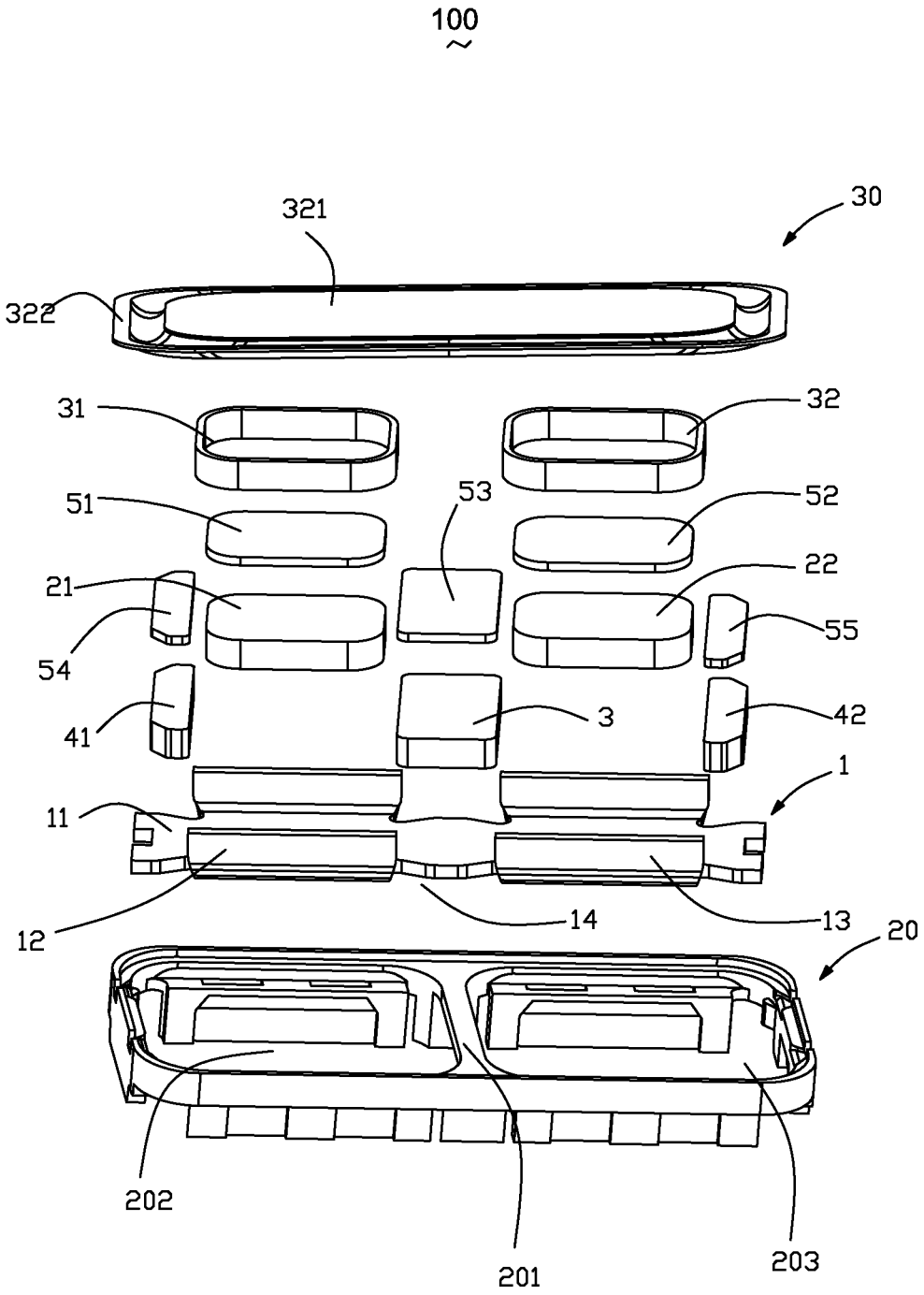
FIG. 2 an exploded view of a speaker using the multi-magnet system in FIG. 1.

Referring to FIGS. 1 and 2, a multi-magnet system 10 in accordance with a first exemplary embodiment of the present invention defines a longitudinal direction L1 and a lateral direction L2 perpendicular to the longitudinal direction. The multi-magnet system 10 comprises a yoke 1 having a bottom 11, a pair of main magnets 21, 22 separated from each other and mounted on the bottom 11 of the yoke 1, respectively, a mid-magnet 3 mounted on the bottom 11 of the yoke 1 and located between the pair of main magnets 21 in the lateral direction L2, and a pair of auxiliary magnets 41, 42 attached to two ends of the yoke 1 in the lateral direction L2. The multi-magnet system 10 further defines a plurality of plate poles attached on the magnets, labeled as 51-55. The mid-magnet and the main magnets are all located between the two auxiliary magnets.

Referring to FIGS. 1 and 2, The yoke 1 further defines a pair of first longitudinal sidewalls 12, a pair of second longitudinal sidewalls 13, and a groove 14 located between the first longitudinal sidewalls 12 and the second longitudinal sidewalls 13 for accommodating the mid-magnet 3. When assembled, the first main magnet 21 is located between the pair of first longitudinal sidewalls 12, the second main magnet 22 is located between the pair of second longitudinal sidewalls 13, the pair of the auxiliary magnets 41, 42 are engaged with one end of the first and second longitudinal sidewalls 12, 13, and the mid-magnet 3 is engaged with another end of the first and second longitudinal sidewalls 12, 13, respectively. Each of auxiliary magnets 41, 42 is parallel to the mid-magnet 3 and the auxiliary magnets 41, 42 are perpendicular to the longitudinal sidewalls 12, 13.

In this embodiment, the main magnets 21, 22 are magnetized in a direction perpendicular to the bottom 11 of the yoke 1. However, in alternative embodiment, the magnetized direction of the main magnets is parallel to the bottom of the yoke. The mid-magnet 3 and the auxiliary magnets 41, 42 are magnetized in a direction perpendicular to the bottom 11 of the yoke 1 and opposite to the main magnets 21, 22, respectively. The longitudinal sidewalls 12, 13 are separated from the main magnets 21, 22, so as to the first main magnet 21 together with the first auxiliary magnet 41, the pair of the first longitudinal sidewalls 12 and the mid-magnet 3 defines a first circle magnetic gap 91 for generating magnetic force. The second main magnet 22 together with the second auxiliary magnet 42, the pair of the second longitudinal sidewalls 13 and the mid-magnet 3 defines a second circle magnetic gap 92 for generating magnetic force.

Referring to FIG. 2, a speaker 100 using the multi-magnet system 10 of the first exemplary embodiment of the present invention comprises a frame 20 forming at least one hollow space for receiving the multi-magnet system 10, a diaphragm 30 defining at least a vibrating membrane 321, and a pair of voice coil 31, 32 attached on the diaphragm 30. Each of the voice coils 31, 32 defines an end suspended in the corresponding magnetic gap generating magnetic force for driving the corresponding coil 31 or 32 and another end connected with the vibrating membrane 321. In fact, the voice coils can be directly connected to the diaphragm, and can also be connected to the diaphragm via a medium. In this exemplary embodiment, the frame 20 defines a brace 201 at a middle portion thereof for forming a first hollow space 202 and a second hollow space 203. However, the amount of the hollow spaces is not limited or restricted to two, and according to different desires, amount of the hollow spaces can be various. The diaphragm 30 further defines an edge 322 surrounding the vibrating membrane 321. The multi-magnet system 10 is symmetrical with respect to a geometric center thereof. Thus, a magnetic flux density exerting on the voice coils 31, 32 is equal and the vibrating of the diaphragm is stable and balanced.

While assembled, referring to FIG. 1 and FIG. 2, the first magnetic gap 91 received in the fist hollow space 202 and the second magnetic gap 92 received in the second hollow space 203. In the same time, the first voice coil 31 is partially suspended in the first hollow space 202, and the second voice coil 32 is partially suspended in the second hollow space 203. The edge 322 of diaphragm 20 is fixed to the frame 20. When electrified, the first voice coil 31 and the second voice coil 32 synchronously drive the vibrating membrane 321 to vibrating.

Figure 3:
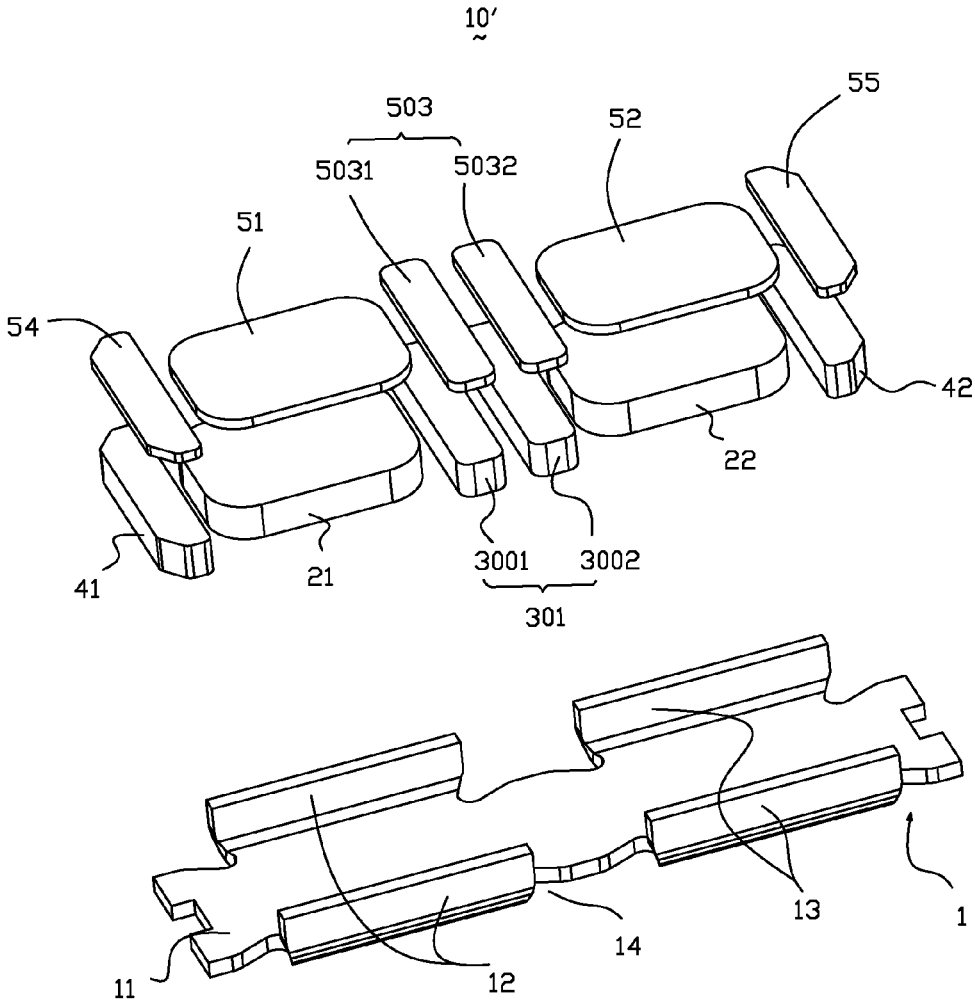
FIG. 3 is an exploded view of a multi-magnet system in accordance with a second exemplary embodiment of the present invention.

A second embodiment of the present invention is shown in FIG. 3. FIG. 3 shows a multi-magnet system 10' similar to that of the first embodiment of the present invention except that a mid-magnet 301 is divided into two parts, named as a first mid-magnet 3001 and a second mid-magnet 3002 separated from the first mid-magnet 3001 and a pole plate 503 of the mid-magnet 301 is divided into two parts, name as a first mid-pole plate 5031 and a second mid-pole plate 5032. The first mid-magnet 3001 is parallel to the second mid-magnet 3002. A wide of the first mid-magnets 3001 is equal to that of the second mid-magnet 3002 and the wide of the first and second mid-magnets 3001, 3002 is equal to that of the auxiliary magnets 41, 42, so a magnetic flux density exerting on the voice coils 31, 32 is equal and the vibrating of the diaphragm is stable and balanced.

Figure 4:
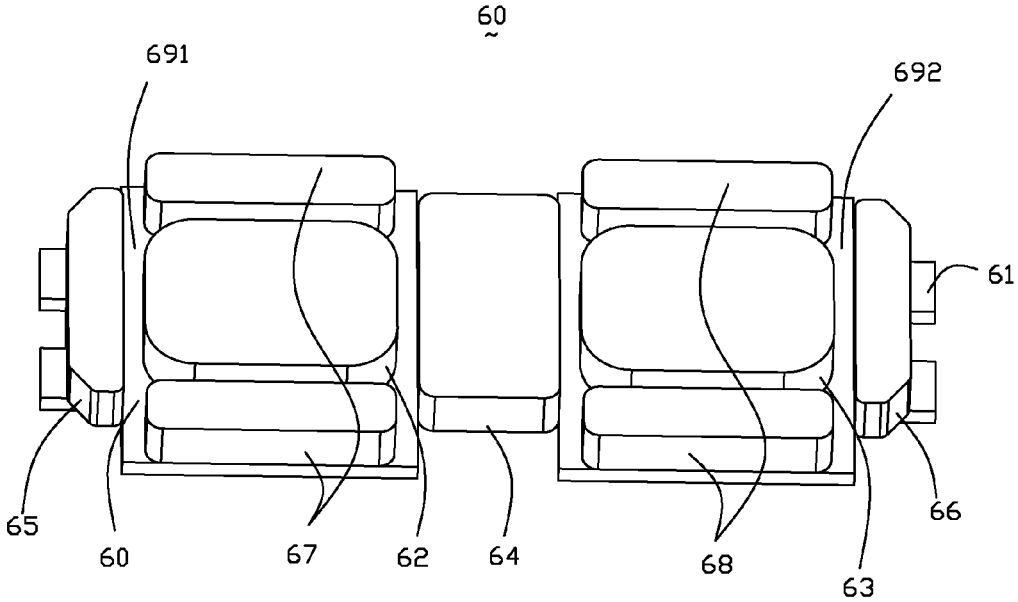
FIG. 4 is an illustrative assembled view of a multi-magnet system in accordance with a third exemplary embodiment of the present invention.

A third embodiment of the present invention is shown in FIG. 4. FIG. 4 shows a multi-magnet system 60 comprises a yoke 61, a first main magnet 62 mount on the yoke 61 having a bottom (no labeled), a second main magnet 63 separated from the first magnet 62 and mounted on the yoke 61, a mid-magnet 64 attached on the yoke 61 and located between the main magnets 62, 63 in the lateral direction L2, a first auxiliary magnet 65 attached to one end of the yoke 61 in lateral direction L2, a second auxiliary magnet 66 attached to another end of the yoke 61 in the lateral direction L2, a pair of first longitudinal magnets 67 surrounding the first main magnet 62 together with the first auxiliary magnet 65 and the mid-magnet 64, and a pair of the second longitudinal magnets 68 surrounding the second main magnet 63 together with the second auxiliary magnet 66 and the mid-magnet 64. If desired, the multi-magnet system further defines a plurality of plate poles attached on the magnets. The mount of the pole plate is equal to that of the magnets.

The first and second longitudinal magnets 67, 68 are magnetized in a direction opposite to the main magnets 62, 63. The first main magnet 62 together with the first auxiliary magnet 65, the pair of the first longitudinal magnets 67 and the mid-magnet 64 defines a first magnetic gap 691. The pair of the first longitudinal magnets 67 is parallel to each other.

The second main magnet 63 together with the second auxiliary magnet 66, the pair of the second longitudinal magnets 68 and the mid-magnet 64 further defines a second magnetic gap 692. The pair of the second longitudinal magnets 68 is parallel to each other.

A fourth embodiment of the present invention: A multi-magnet system 60' of the fourth embodiment of the present invention similar to that of the third embodiment of the present invention except that the mid-magnet is divided into two parts, named as a first mid-magnet and a second mid-magnet separated from the first mid-magnet. The first mid-magnet is parallel to the second mid-magnet.

By virtue of place the magnets at appropriate locations, the sensitivity of the speaker is effectively enhanced.

Be noted that even though the speaker in the exemplary embodiment is provided with two vibrating membranes and two voice coils, the disclosure is not limited to the configuration described above. In fact, the speaker may be provided with three or more vibrating membranes and voice coils.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. A multi-magnet system, comprising:

a yoke having a bottom;

a pair of main magnets separated from each other and mounted on the bottom of the yoke, respectively, the main magnets including a first main magnet and a second magnet;

a mid-magnet mounted on the bottom of the yoke and located between the pair of main magnets, the mid-magnet magnetized in a direction opposite to the main magnets;

a first auxiliary magnet attached to one end of the yoke and located adjacent to the first main magnet, the first auxiliary magnet magnetized in a direction opposite to the main magnets; and a second auxiliary magnet attached to the other end of the yoke and located adjacent to the second main magnet, the second auxiliary magnet magnetized in a direction opposite to the main magnets;

wherein, the first main magnet together with the first auxiliary magnet and the mid-magnet defines a first magnetic gap for generating magnetic force and the second main magnet together with the second auxiliary magnet and the mid-magnet defines a second magnetic gap for generating magnetic force.

2. The multi-magnet system as described in claim 1, wherein the mid-magnet is divided into two parts.

3. The multi-magnet system as described in claim 1, wherein the yoke further defines a pair of first longitudinal sidewalls extending upwardly from the bottom of the yoke and surrounding the first main magnet together with the first auxiliary magnet and the mid-magnet and a pair of the second longitudinal sidewalls extending upwardly from the bottom of the yoke and surrounding the second main magnet together with the second auxiliary magnet and the mid-magnet; the longitudinal sidewalls are separated from the main magnets, respectively.

4. The multi-magnet system as described in claim 1, wherein the multi-magnet system is symmetrical with respect to a geometric center thereof.

5. The multi-magnet system as described in claim 4, wherein each of auxiliary magnets is parallel to the mid-magnet.

6. The multi-magnet system as described in claim 5, wherein the auxiliary magnets are perpendicular to the longitudinal sidewalls.

7. A multi-magnet system, comprising:

a yoke having a bottom;

a pair of main magnets separated from each other and mounted on the bottom of the yoke, respectively, the pair of main magnets including a first main magnet and a second main magnet;

a mid-magnet mounted on the bottom of the yoke and located between the pair of main magnets, the mid-magnet magnetized in a direction opposite to the main magnets;

a pair of auxiliary magnets attached to two ends of the yoke, the auxiliary magnets including a first auxiliary magnet attached to one end of the yoke and a second auxiliary magnet attached to another end of the yoke, the auxiliary magnets magnetized in a direction opposite to the main magnets;

a pair of first longitudinal magnets surrounding the first main magnet together with the first auxiliary magnet and the mid-magnet; and a pair of the second longitudinal magnets surrounding the second main magnet together with the second auxiliary magnet and the mid-magnet;

wherein, the first and second longitudinal magnets are magnetized in a direction opposite to the main magnets; and the first main magnet together with the first auxiliary magnet, the pair of the first longitudinal magnets and the mid-magnet defines a first magnetic gap and the second main magnet together with the second auxiliary magnet, the pair of the second longitudinal magnets and the mid-magnet further defines a second magnetic gap.

8. The multi-magnet system as described in claim 7, wherein the mid-magnet is divided into two parts.

9. The multi-magnet system as described in claim 8, wherein the multi-magnet system is symmetrical with respect to a geometric center thereof.

10. The multi-magnet system as described in claim 9, wherein the pair of the first longitudinal magnets is parallel to each other.

11. The multi-magnet system as described in claim 10, wherein the pair of the second longitudinal magnets is parallel to each other.

12. A speaker, comprising:

a multi-magnet system as described in claim 1;

a frame forming at least one hollow space for receiving the multi-magnet system;

a diaphragm mounted on the frame; and a pair of voice coil driving the diaphragm and suspended in the first and second magnetic gaps, respectively; and the first and second magnetic gaps is capable of generating magnetic force for driving the voice coil, respectively.

13. The speaker as described in claim 12, wherein the frame defines a brace at a middle portion thereof for dividing the hollow space into a first hollow space for receiving the first voice coil and a second hollow space for receiving the second voice coil.

14. The speaker as described in claim 13, wherein the mid-magnet is divided into two parts.

15. The speaker as described in claim 14, wherein the multi-magnet system is symmetrical with respect to a geometric center thereof.

* * * * *